United States Patent [19]

Walter

[11] Patent Number: 5,009,272

[45] Date of Patent: Apr. 23, 1991

[54] FLOW PULSING METHOD AND APPARATUS FOR DRILL STRING

[75] Inventor: Bruno H. Walter, Edmonton, Canada

[73] Assignee: Intech International, Inc., Edmonton, Canada

[21] Appl. No.: 436,603

[22] Filed: Nov. 15, 1989

[30] Foreign Application Priority Data

Nov. 25, 1988 [CA] Canada ..... 584145
Jun. 22, 1989 [CA] Canada ..... 603594

[51] Int. Cl.[5] ..... E21B 7/18; E21B 7/24; E21B 4/14; E21B 31/113

[52] U.S. Cl. ..... 175/56; 175/67; 175/232; 175/297; 166/177; 166/249; 166/286; 166/312

[58] Field of Search ..... 175/296, 297, 56, 25, 175/38, 65, 67, 241, 242, 232, 298, 317; 166/177, 178, 286, 301, 249, 308, 319, 320; 367/83, 85; 137/14, 829, 830

[56] References Cited

U.S. PATENT DOCUMENTS

| | | | |
|---|---|---|---|
| 701,391 | 6/1902 | Pruszkowski | 175/92 |
| 2,287,157 | 6/1942 | Wolff | 175/106 |
| 2,620,162 | 12/1952 | Pennington | 175/232 X |
| 2,713,472 | 7/1955 | Bodine, Jr. | 175/56 |
| 2,743,083 | 4/1956 | Zublin | 175/56 |
| 2,746,721 | 5/1956 | Moore | 175/317 |
| 2,750,154 | 6/1956 | Boice | 175/106 X |
| 2,780,438 | 2/1957 | Bielstein | 175/92 |
| 3,065,805 | 11/1962 | Martini | 175/56 |
| 3,096,833 | 7/1963 | Bodine | 175/56 |
| 3,105,560 | 10/1963 | Zublin | 175/56 |
| 3,194,325 | 7/1965 | Gianelloni, Jr. | 175/107 |
| 3,307,641 | 3/1967 | Wiggins, Jr. | 175/56 |
| 3,346,058 | 10/1967 | Bouyoucos | 175/56 |
| 3,415,330 | 12/1968 | Bouyoucos | 175/56 |
| 3,416,613 | 12/1968 | Henderson | 173/57 |
| 3,431,984 | 3/1969 | Buehler, Jr. | 175/297 |
| 3,441,094 | 4/1969 | Galle et al. | 175/56 |
| 3,568,783 | 3/1971 | Chenoweth | 175/92 |
| 3,768,576 | 10/1973 | Martini | 173/73 |
| 3,807,512 | 4/1974 | Pogonowski et al. | 175/106 |
| 3,958,217 | 5/1976 | Spinnier | 367/83 |
| 4,434,863 | 3/1984 | Garrett | 175/321 |
| 4,520,886 | 6/1985 | Marais | 173/135 |
| 4,807,709 | 2/1989 | Falgout, Sr. et al. | 166/178 X |
| 4,817,739 | 4/1989 | Jeter | 175/317 X |
| 4,819,745 | 4/1989 | Walter | 175/107 |
| 4,830,122 | 5/1989 | Walter | 175/106 |

FOREIGN PATENT DOCUMENTS

| | | | |
|---|---|---|---|
| 3323774 | 2/1984 | Fed. Rep. of Germany . | |
| 1035202 | 8/1983 | U.S.S.R. | 166/177 |

OTHER PUBLICATIONS

Johnson, Jr. et al., "Cavitating and Structured Jets for Mechanical Bits to Increase Drilling Rate", A.S.M.E., Mar. 7-10, 1982, 16 pages.

*Primary Examiner*—Stephen J. Novosad
*Attorney, Agent, or Firm*—John W. Ross; Robert M. Phipps

[57] ABSTRACT

This invention relates to flow pulsing methods and apparatus for various applications including downhole drilling equipment and in particular to an improved flow pulsing method and apparatus of this type to be connected in a drill string above a drill bit with a view to securing improvements in the drilling process.

24 Claims, 8 Drawing Sheets

FLOW PULSING METHOD AND APPARATUS FOR DRILL STRING

This invention relates to flow pulsing methods and apparatus for use in various applications, such as in down-hole drilling equipment and in particular to an improved flow pulsing method and apparatus of this type adapted to be connected in a drill string above a drill bit with a view to securing improvements in the drilling process.

This application is related to my copending application Ser. No. 07/323,624, filed Mar. 14, 1989 for "Flow Pulsing Apparatus And Method for Down-Hole Drilling Equipment", which in turn is related to U.S. Pat. No. 4,830,122 issued May 16, 1989, which in turn is related to my U.S. Pat. No. 4,819,745, issued Apr. 11, 1989.

Bruno H. Walter U.S. Pat. No. 4,819,745 issued Apr. 11, 1989 contains a detailed description of the classical rotary drilling method and the manner in which drilling fluid or drilling mud is pumped downwardly through the hollow drill string with the drilling mud cleaning the rolling cones of the drill bit and removing or clearing away rock chips from the cutting surface and then lifting and carrying such rock chips upwardly along the well bore to the surface. That patent discusses the effect of jets on the drill bit to provide high velocity fluid flows near the bit. In general, these jets serve to increase the effectiveness of the drilling, i.e. they increase the penetration rate.

The above U.S. patent also describes the use in the drill string of vibrating devices thereby to cause the drill string to vibrate longitudinally, which vibrations are transmitted through the drill bit to the rock face thus increasing the drilling rate. Certain of the earlier devices include mud hammers while others include turbine driven rotary valve devices for periodically interrupting the flow of mud in the drilling string just above the drill bit thereby to provide a cyclical or periodic water-hammer effect which axially vibrates the drill string and vibrates the drill bit thus increasing the drilling rate somewhat. These prior art devices were subject to a number of problems as noted in the above U.S. Pat. No. 4,819,745.

More recent forms of apparatus for increasing the drilling rate by periodically interrupting the flow to produce pressure pulses therein and a water-hammer effect which acts on the drill string to increase the penetration rate of the bit are described in my U.S. Pat. No. 4,830,122 issued May 16, 1989 and in my copending application Ser. No. 07/323,624 filed Mar. 14, 1989. These devices (incorporating axially movable valve members) have provided a significant improvement over the known prior art rotary valve arrangements and have been less prone to jamming and seizing as the result of foreign matter in the drilling fluid. At the same time there is a need to improve still further the operating characteristics of the device and to enable the production of high frequency pulsations while at the same time providing for a reduced incidence of jamming or sticking of the apparatus as a result of the action of foreign matter travelling downwardly with the drilling fluid.

Reference should also be had to a paper entitled "Cavitating and Structured Jets For Mechanical Bits To Increase Drilling Rate" by V. E. Johnson, Jr. et al which paper was contributed by the Petroleum Division of The American Society of Mechanical Engineers for presentation at the Energy-Sources Technology Conference & Exhibition, Mar. 7-10, 1982, New Orleans, Louisiana. (Manuscript received at The American Society of Mechanical Engineers Headquarters on Dec. 10, 1981). This paper describes how the erosion and cleaning effect of drill bit jets is enhanced when the degree of cavitation occurring on or near the bottom of the hole increased. Self-excited, acoustically resonating nozzles causing jets to be structured with large discrete vortex rings that promote cavitation to depths several times greater than for conventional jets are described. It is stated that these nozzle designs are shown to be suitable for existing mechanical drill bits and may affect hole cleaning in the absence of cavitation.

In view of the above it would be very desirable to provide flow pulsing apparatus for use in a drill string which would allow the flow pattern of the drill bit jets to be structured in the manner as described in the above-noted paper. The effects of jet structuring on bottom hole cleaning are, as noted above, well described in the above-referred to paper.

SUMMARY OF THE INVENTION

It is a general object of the present invention to provide improved flow pulsing methods and apparatus for various applications wherein vibrating and/or flow pulsing effects are desired, for example, vibrating a drill string and a drill bit to increase the drilling rate and to pulse the flow of drilling fluid emitting from the drill bit jets thereby to enhance the cleaning effect and the drilling rate. A further object is to provide flow pulsing methods and apparatus capable of providing "structured" jets at the drill bit thereby to enhance bottom hole cleaning.

Accordingly, the invention in one aspect provides a flow pulsing apparatus including a housing providing a passage for a flow of fluid and means for periodically interrupting the flow through said passage to create pulsations in the flow and a cyclical water-hammer effect to vibrate the housing during use. In particular, the above-noted passage includes a constriction means through which the flow is accelerated so as to substantially increase the flow velocity and a passage region through which the accelerated fluid can flow, followed by a downstream region of fluid deceleration. In order to effect the periodic interruption of the flow a control means is associated with the passage region and is movable between an open, full flow position, and a closed flow interrupting position. This control means is responsive to alternating differential fluid pressures acting on opposing sides thereof so as to move or vibrate the control means rapidly between the above-noted positions to pulsate the flow. The alternating differential pressures are created as a result of the fact that in the open position of the control means the fluid throughflow at relatively high velocity effects a pressure reduction on one side of the control means (by virtue of the Bernoulli effect) while the pressure on the other side is higher (as it is exposed to the higher pressures associated with the downstream lower velocity region) thus tending to effect closure of the control means. However, once closure or flow interruption occurs, the pressure and force differential on the control means is reversed because of the water-hammer effect created upstream of the control means coupled with a pressure drop on the downstream side. This action serves to rapidly open the control means whereupon the differential pressure acting on the control means is again reversed so that the sequence described above repeats itself. This action occurs in a rapid cyclical manner and relatively high pulsation frequencies can be achieved.

The invention also includes a flow pulsing method including the basic actions noted above.

In the preferred form of the invention the flow pulsing apparatus is adapted to be connected in a drill string above a drill bit to "pulse" the flow of drilling fluid Passing toward the bit thereby to vibrate the drill bit and enhance the hole bottom cleaning effect, thus increasing the drilling rate.

In the embodiments to be described hereafter the control means take several different forms. In one group of embodiments it is in the form of one or more pivoting flap valves. Flap valve arrangements providing differing pulse durations (pulse widths) are provided. Another embodiment provides an axially movable valve while a still further embodiment provides a flexible tube-like flow control element. Regardless of the form of the control means, all of them are in use acted on by the alternating differential pressures arising during use to achieve the flow pulsing effect desired.

The invention will be better understood from the following description of preferred embodiments of same, reference being had to the accompanying drawings.

BRIEF DESCRIPTION OF THE VIEWS OF DRAWINGS

Figure 1:
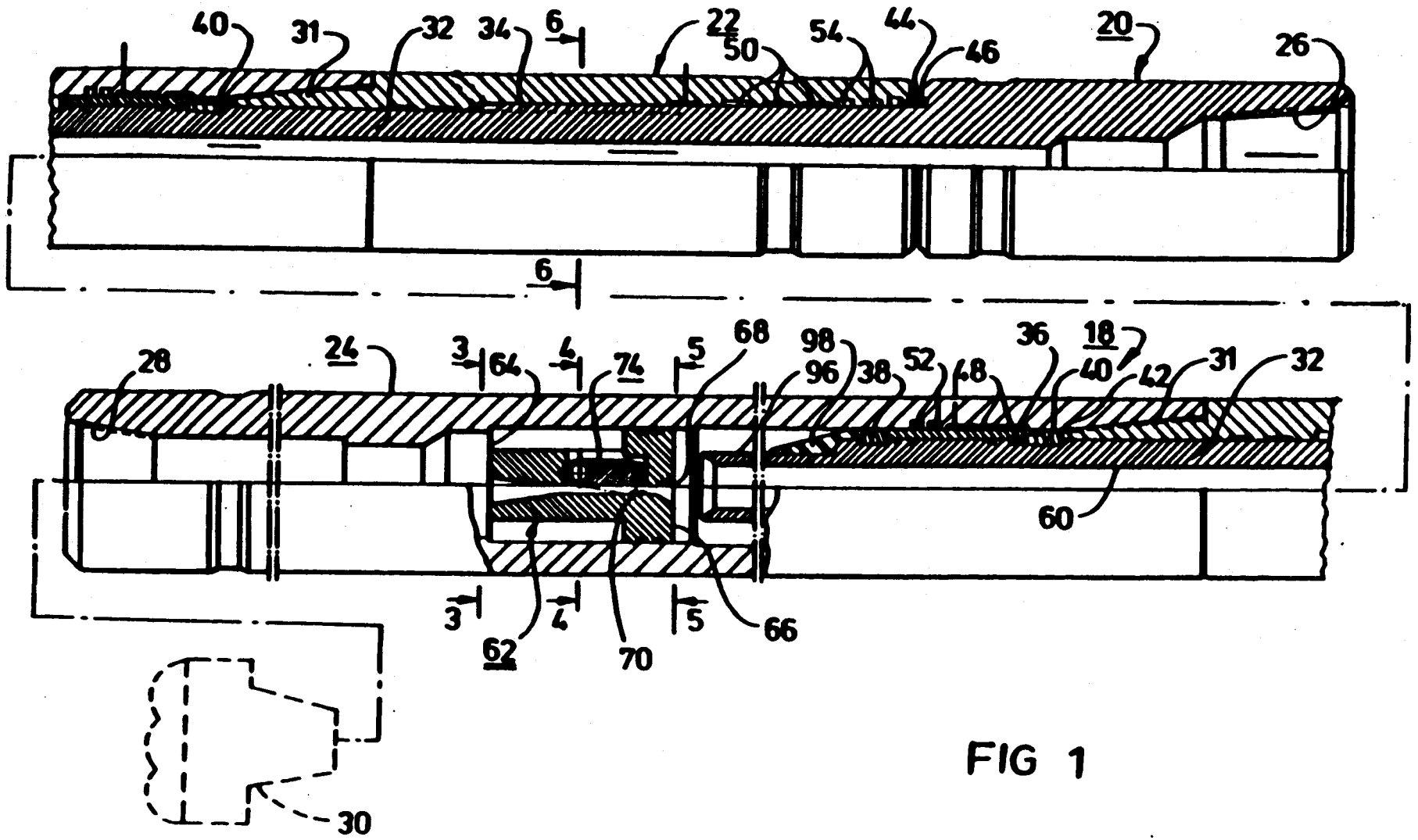
FIG. 1 is a longitudinal section through an apparatus for producing high frequency pulses in the drilling fluid in accordance with a preferred embodiment of the invention.
Figure 2:
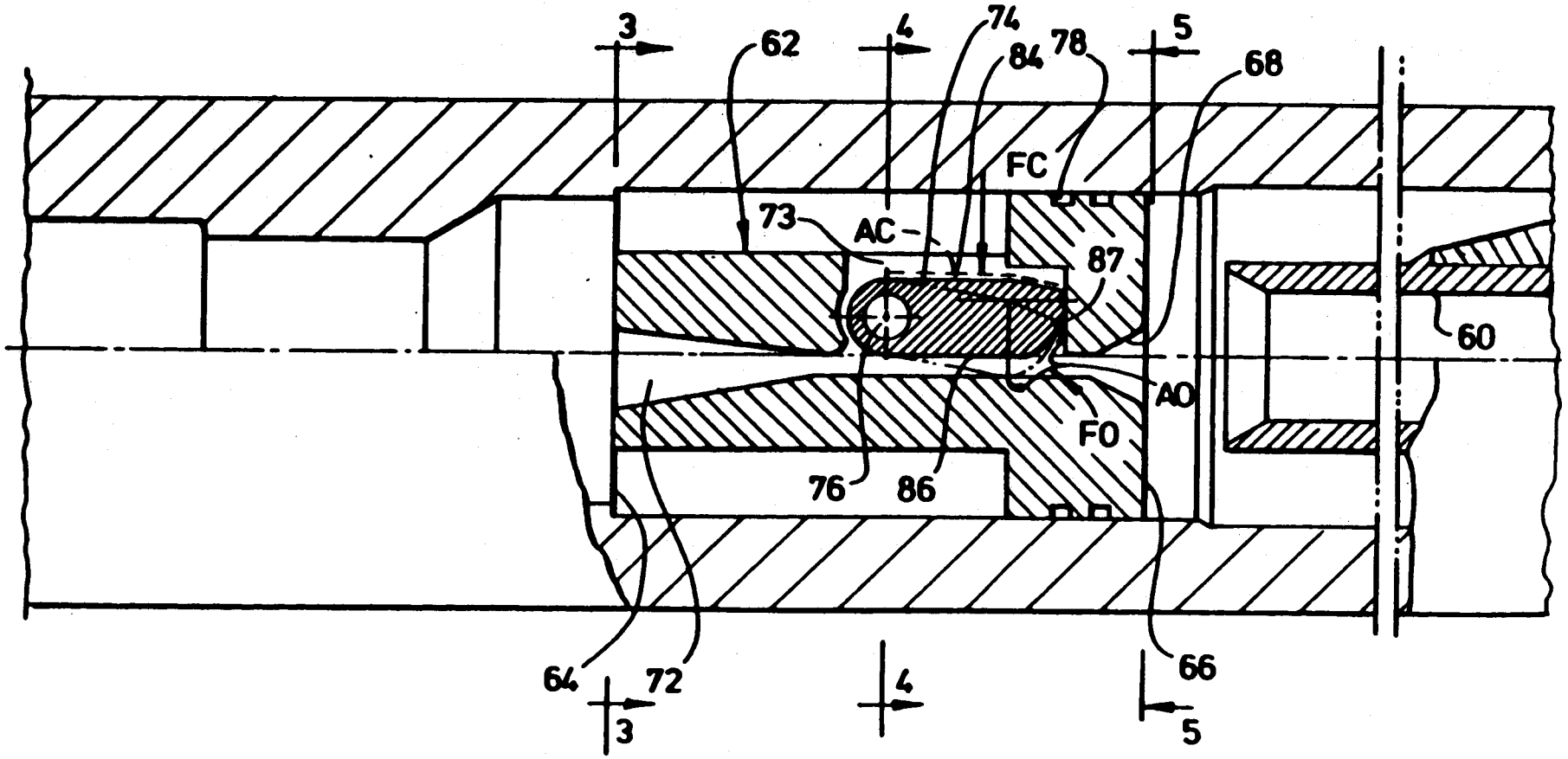
FIG. 2 is an enlarged portion of FIG. 1 showing the flow pulsing means in further detail.
Figure 5:
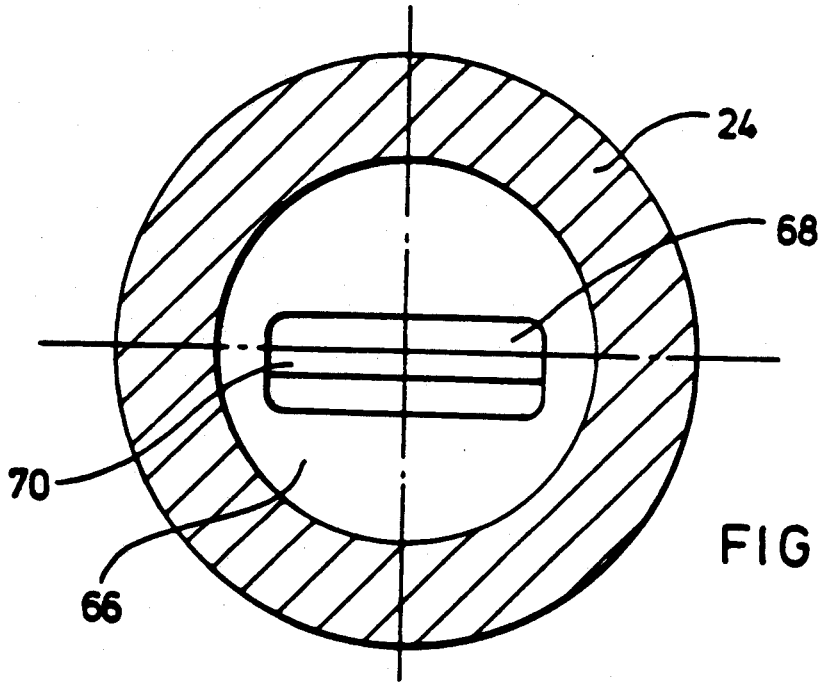
Figure 6:
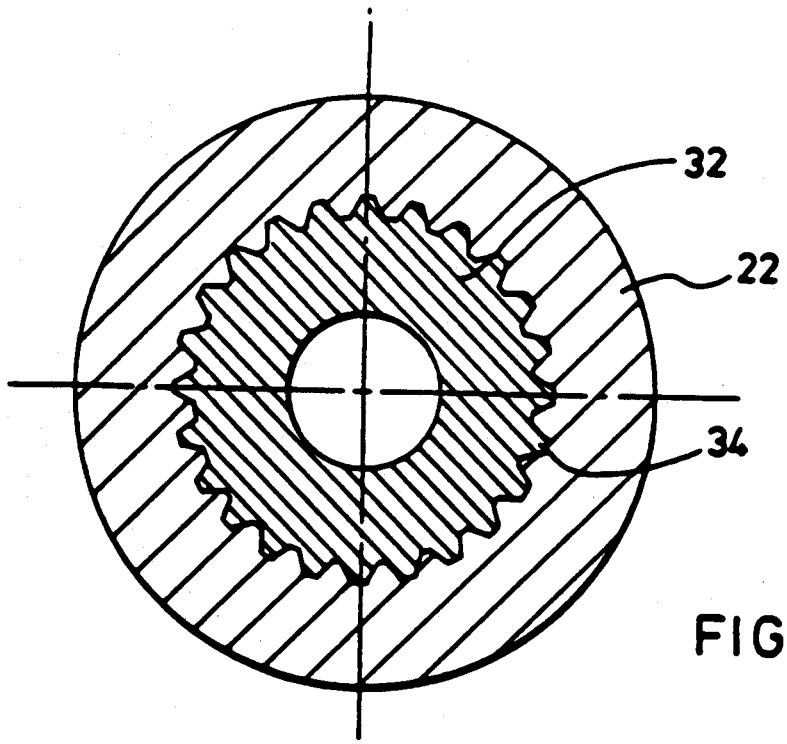
Figure 8:
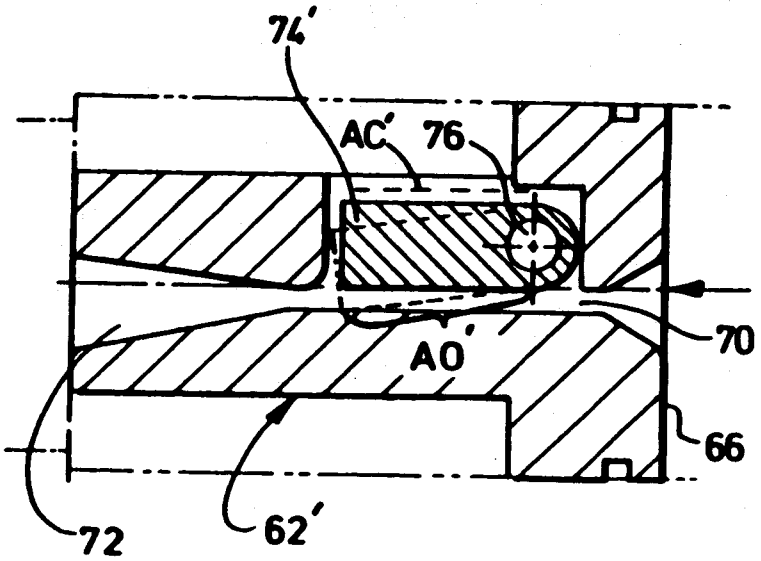
Figure 7:
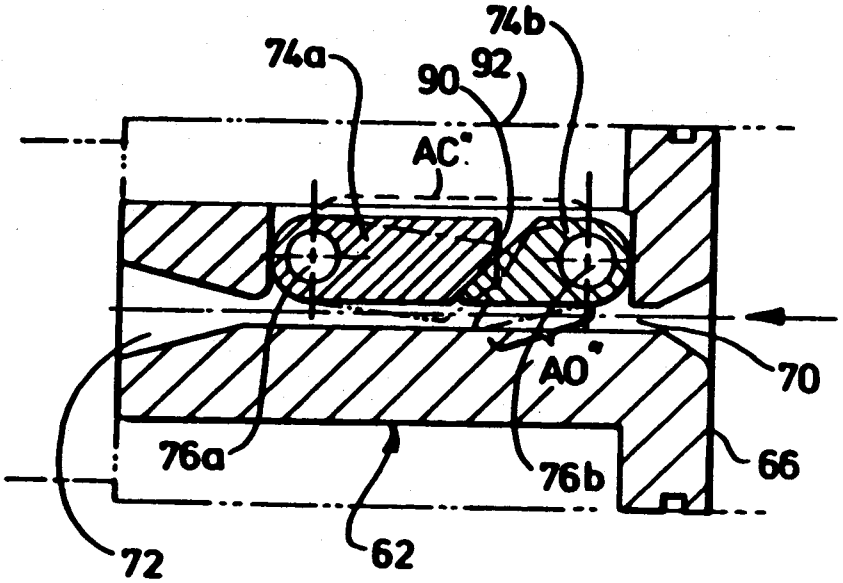
Figure 11:
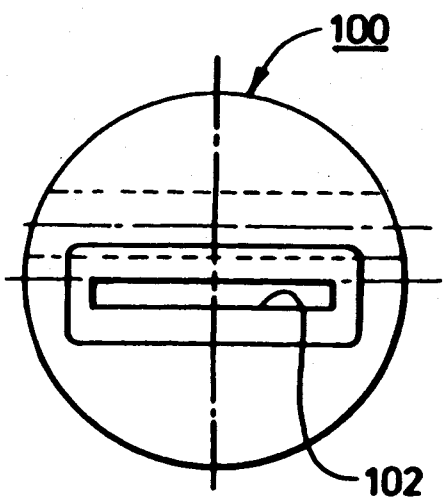
Figure 10:
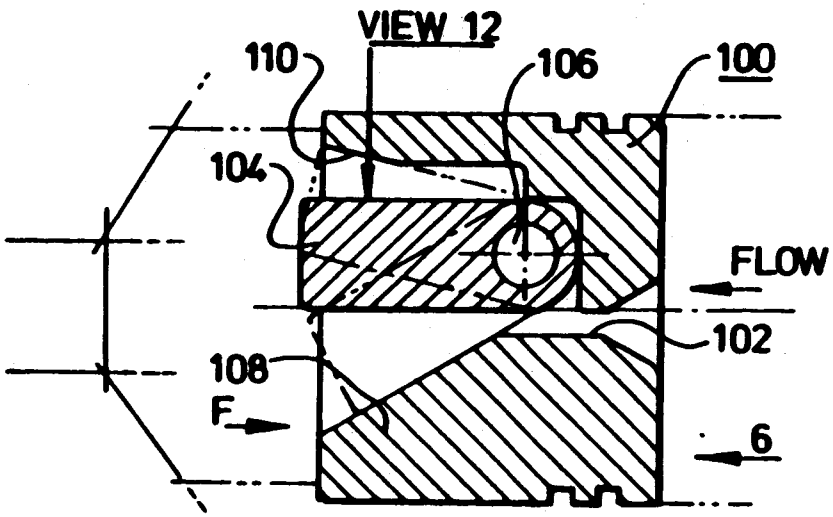
Figure 12:
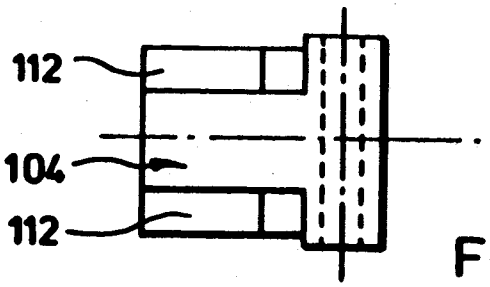
Figure 9:
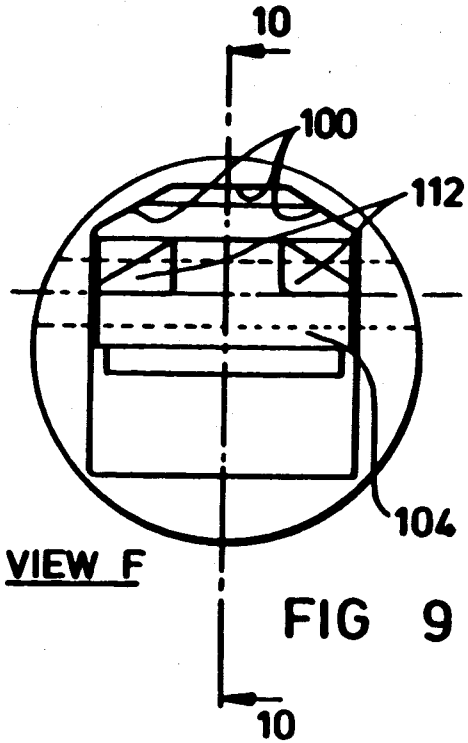
Figure 13:
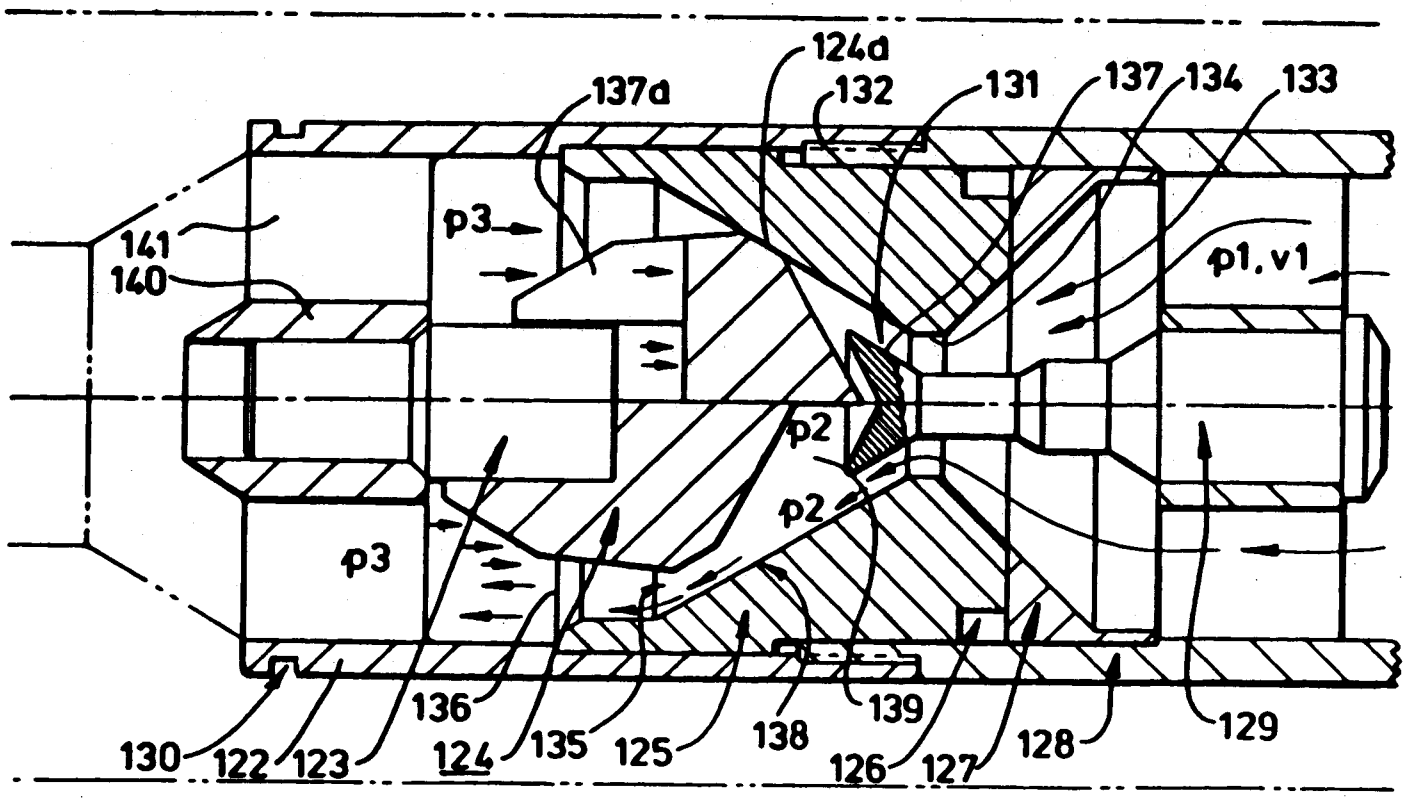

FIG. 5 a cross-section view taken along line 5—5 of FIG. 1 or 2;

FIG. 6 is a cross-section view taken along line 6—6 of FIG. 1;

FIGS. 7 and 8 are longitudinal section views of alternate forms of flow pulsing devices for use in the embodiment of FIG. 1;

FIG. 9 is an end elevation view of a further embodiment of a flow pulsing device;

FIG. 10 is a section view along line 10—10 of FIG. 9;

FIG. 11 is an opposing end view thereof;

FIG. 12 is an elevation view of the flap looking in the direction of arrows 12;

FIG. 13 is a longitudinal section view of a still further embodiment having an axially movable valve for producing pulses in the drilling fluid.

Figure 14:
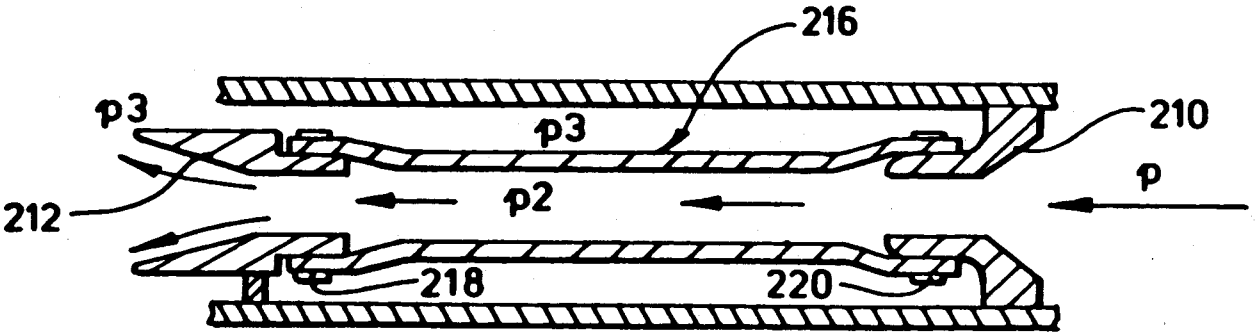

FIG. 14 is a longitudinal section view of a still further embodiment employing a flexible tubular flow pulsing element.

DETAILED DESCRIPTION OF THE PREFERRED EMBODIMENTS

Referring to FIGS. 1-6 a preferred embodiment of the invention is shown in detail. The apparatus 18 includes an external tubular housing including upper housing 20, intermediate housing 22, and lower housing 24. Upper housing 20 has an internally threaded portion 26 for connection to the lower end of a drill string (not shown), while lower housing 24 has an internally threaded portion 28 for connection to a conventional drill bit 30 (shown in phantom) having conventional bit jets 31 for bottom hole cleaning as noted previously. Intermediate housing 22 is connected to lower housing 24 via tapered threaded portions 31.

The upper housing 20 has an elongated neck 32 which extends within the intermediate housing 22 and well down into the lower housing 24. Interengaging splines 34 between the housings 20 and 22 serve to transmit torque while allowing a measure of relative axial movement between them.

The lower end of the neck 32 is surrounded by a sleeve 36 having a smooth hard surface. Split rings 38 and 40 butt against opposing ends of sleeve 36 and the uppermost split ring 40 can make contact with shoulder 42 on the lower end of intermediate housing 22 to retain the upper housing 20 in place. A limited amount of axial play between the upper housing 20 and the lower and intermediate portions 24,22 is permitted with shoulders 44, 46 on the intermediate and upper housings 22, 20 making contact when the weight of the drill string is applied (as during drilling) while split ring 40 butts up against shoulder 42 when the tool is under tension (as during lifting out of the hole). Wear rings 48, 50 and seal rings 52, 54 are provided between the relatively movable assemblies described above and a suitable lubricant is provided on the relatively movable surfaces.

The neck 32 of the upper housing portion 20 has an elongated central bore 60 therein of constant diameter defining a passage for drilling fluid from the upper end of the tool downwardly toward the flow control means which will now be described.

Seated in the central passage defined by the bottom housing 24 just downstream of the neck 32 and against a step 64 provided in the housing interior wall is a Venturi assembly having a valve therein that provides intermittent interruption of the flow of drilling mud or fluid. The drilling mud or fluid is pumped downwardly in well known fashion through the drill string from the surface and passes along the bore 60 in neck 32 in the direction of the arrows. The manner in which this flow is intermittently interrupted or pulsed will be apparent from the following description.

The several views (FIGS. 3-5) taken through the assembly show the Venturi assembly as including a Venturi body 62 having an upstream face 66 within which is defined an area of gradual flow constriction 68 (a downwardly tapering area), a passage region of high velocity (having a rectangular slot-like cross-section) designated as 70 and a downstream region of gradual expansion defined by diffuser 72 (also of rectangular slot-like configuration).

In the upper portion of the Venturi body 62 there is provided a pocket 73 within which a flap 74 is freely pivoted at its downstream end by means of a transverse pivot shaft 76. The open full-flow position of the flap 74 is shown in full lines (i.e. the flap 74 is within its pocket clear of the passage region 70) while the dotted lines show the position of the flap when such flap is in the closed, flow interrupting position (i.e. the upstream portion of flap 74 is within the passage region 70). The flap 74 shown in FIGS. 1 and 2 has flattened inside and outside faces 86, 84 and a convexly curved upstream end surface 87. Flap 74 has a rectangular outline shape when seen end-on (looking in the axial direction) and also when seen looking toward the inside or outside faces 84, 86.

The fluid pressure acting above the Venturi body 62 is sealed by high pressure annular seals 78 interposed between the body 62 and the housing interior wall. The various components including the Venturi body 62 and the flap 74 are made of a hard surfaced metal to reduce wear arising from contact with the drilling fluid.

Figure 3:
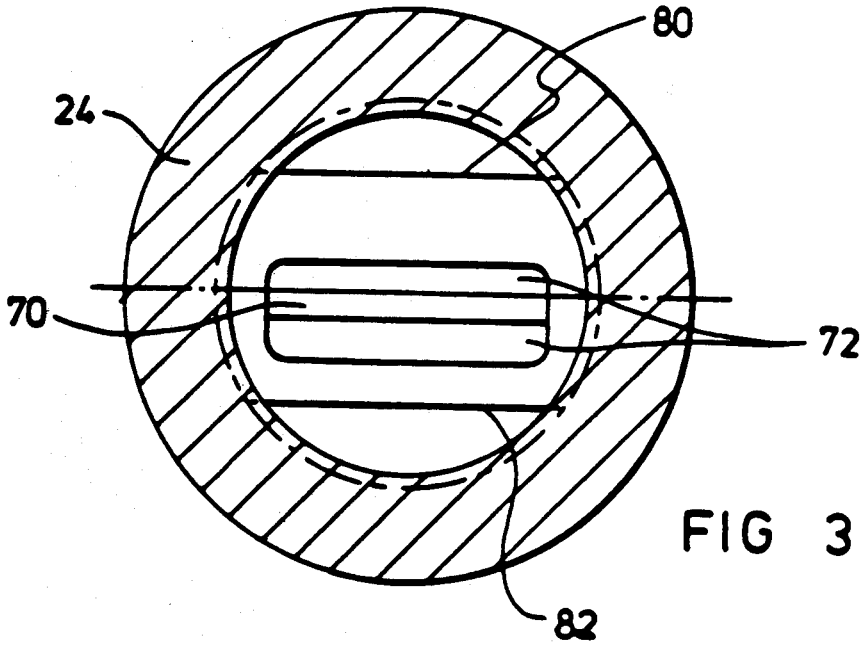
FIG. 3 is a cross-section view taken along line 3—3 of FIG. 1 or 2.
Figure 4:
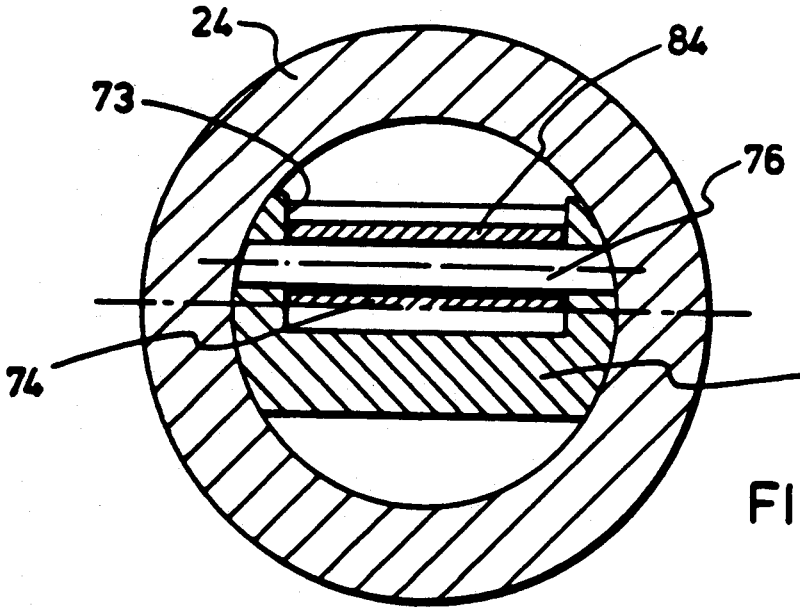
FIG. 4 is a cross-section view taken along line 4—4 of FIG. 1 or 2.

FIG. 4 shows a cross-section taken along line 4—4 of FIG. 1 in this view, the flap 74 is shown in its relationship to the Venturi body 62. The downstream end of the Venturi body 62 is further illustrated in the cross-sectional view of FIG. 3. FIG. 5 shows a cross-section of the tool upstream of the Venturi body 62. The shape of the tapering flow constriction 68 and the high velocity passage region 70 are clearly shown.

The Venturi body 62, as best seen in FIGS. 3 and 4, is shaped in such a way (with flattened side portions 80 and 82) and with the pocket 73 in which flap 74 is located being "open" on side 80 (FIG. 4) that the outside face 84 of the flap is effectively exposed to the fluid pressure existing downstream of the diffuser section 72. At the same time the opposing inside face 86 is at least partially exposed to the fluid within the high velocity passage 70. (The effects of differing flap arrangements including the effective sizes of the areas of the flap faces on which the fluid pressures act will be described in further detail later).

In the operation of the embodiment shown in FIGS. 1-5, the drilling fluid or mud is being pumped downwardly through the central bore of the drill string in the direction of the arrows and has pressure and velocity (p1) and (v1) as it moves along the bore 60 and approaches the Venturi body 62. As the drilling fluid moves downwardly toward the Venturi body 62, the drilling fluid is accelerated in the flow constriction 68 and it enters the slot-like high velocity passage 70. In this high velocity region 70, the fluid pressure (p2) is reduced in accordance with Bernoulli's principle, i.e. $(p1-p2)=\frac{1}{2}K(v_2^2-v_1^2)$ and this reduced pressure acts on the inside surface 86 of the pivotally mounted flap 74. It is noted here that references to Bernoulli effect are for convenience in describing the First Law (conservation of energy) phenomena occurring. Other 'First Law' effects such as friction losses and heating or cooling effects have been neglected. It will be appreciated by those skilled in the art that the formulation of theory of operation for this equipment poses substantial difficulties in that it is extremely difficult to provide instruments capable of detecting and observing the phenomena occurring during operation.

The drilling fluid then continues downwardly into the diffuser 72 with the result being that the flow velocity decreases (v3) while the pressure (p3) increases, again in accordance with Bernoulli's principle. This pressure (p3), as will be seen from FIGS. 1, 2 and 4, acts on the opposing or outer face 84 of the pivoted flap 74, pressure (p3) being greater than the pressure (p2) acting on the inside face 86 of the flap. The net result is that the flap 74 tends to be forced toward the closed position as shown by the dotted lines. Hence, as a result of this pressure differential acting across the flap, flap 74 suddenly closes thus developing a water-hammer effect above the Venturi body 62 while at the same time the pressure (p3) below the constriction is reduced. The pressure force on the effective inside face of the flap 74 is now greater than pressure force acting on the outside surface of the flap and as a result of this pressure differential flap 74 swings open. The whole process described above now repeats itself rapidly in continuous cyclical fashion. By using this arrangement, and by changing the size and proportion of the several components, the pulsation rate can be made to vary over a relatively wide range.

It should be understood that in all of the disclosed embodiments a measure of back pressure downstream of the flow pulsing device exists at all times during operation. This back pressure arises as a result of the pressure drop across the bit jet nozzles and will vary depending on circumstances. The magnitude of this back pressure is not critical and need not be mentioned further.

It is also noted that the flap, in operation, does not actually make substantial metal-to-metal contact with the Venturi body in the opening and closing positions. At the relatively high pulsation frequencies normally encountered it appears that the drilling fluid may exert a cushioning effect thus reducing the degree of metal-to-metal contact and reducing the wear which would otherwise result.

In the embodiment of FIGS. 1-5 the flap 74 is pivoted by shaft 76 at the downstream end of the flap, i.e. the upstream free end swings in an arc between the open position (wherein the flap 74 is disposed within its pocket 73 in the Venturi body 62) and the closed position wherein the upstream free end portion is located within the passage 70 in the flow interrupting position. It will readily be seen from an inspection of FIG. 2 that the flap closing pressure acts on a relatively large area AC (as shown by the dashed lines), such area comprising almost the whole outer face 84 of the flap 74. The total closing force is of course equal to the applied pressure times this particular area. On the other hand, the flap opening pressure, i.e. the pressure arising from water hammer effect (WHE) acts on only a relatively small area AO (as shown by the full line) such area comprising only the convexly curved upstream end surface 87 of the flap 74. (In this case area AC is more than twice the size of area AC). Further, the resultant of the opening force FO is inclined such that its effective moment arm relative to the axis of pivot shaft 76 is relatively short as compared with the length of the moment arm associated with closing force FC. The result of this is that the valve tends to stay closed for a longer period of time as compared with, for example, the embodiment of FIG. 8. In other words, the width of the pulse arising from the WHE is relatively wide thus providing for a substantial amount of mechanical energy to be transmitted to the bit as will become more apparent hereinafter.

Referring to the embodiment of FIG. 8, only the Venturi body 62, and associated flap 74 are shown. Here the flap 74' is pivoted at its upstream end about pivot shaft 76. Here the flap closing pressure acts on the large area AC' defined by the rectangular outer face of the flap (shown by dashed lines) while the valve opening pressure acts on an equally large area AO' defined by the rectangular inner face of the flap (shown by solid lines). The moment arms of these forces about the pivot axis are almost equal to one another. Since the opening pressure associated with the WHE is quite high, the opening force is also large and the flap 74' opens very quickly as compared with the embodiment of FIGS. 1-5. The pressure pulse width arising from WHE is thus correspondingly narrow and the degree of mechanical energy arising from the pressure pulse is correspondingly less. The embodiment of FIGS. 1-5 is thus to be preferred over the embodiment of FIG. 8 for most situations although if reduced mechanical energy is desired the FIG. 8 embodiment should be selected.

A still further variation is shown in FIG. 7 where a two-part flap comprising flap parts 74*a* and 74*b* are pivoted about respective downstream and upstream pivot shafts 76*a* and 76*b*. The flap parts are coupled together for motion by virtue of the respective inclined surface portions 90, 92. The opening pressure acts on an area AO" which is relatively small compared with the area AC" on which the closing pressure acts thus providing this embodiment with pressure pulse characteristics somewhat similar to those of the FIGS. 1-5 embodiment although at the expense of somewhat great complexity.

It will be seen from the above-described embodiments that if we reduce the flap area subject to the WHE (upstream) in relation to the area on which the flap closing pressure acts we will be able to obtain pressure pulses of longer duration. This means that during flow interruption (closure) the pressure pulse will travel higher upstream (at the speed of sound in liquid) and more fluid (a greater mass) will be stopped and more energy per pulse will be available as compared with, for example, the FIG. 8 embodiment.

Reference was made briefly to the constant diameter elongated bore 60 in the neck through which fluid flows during operation. The effect of diameter changes will become apparent when the flow velocity V is considered. The kinetic energy per pulse ($E=\frac{1}{2}MV^2$) and M=fluid weight/g. The weight=(density×volume) and volume in turn=(cross-sectional area of bore 60×the total length of the decelerated fluid). The total length of decelerated fluid=(speed of sound in drilling fluid ×time (i.e. duration of pressure pulse)). From this it will be understood that the reduced diameter bore 60 should extend upstream at least as far as a pressure wave will travel per cycle. The total energy per second is equal to the energy per pulse times the frequency (Hz).

From the above the advantage of the first flap embodiment (FIGS. 1-5) over the alternate embodiment of FIG. 8 in terms of the mechanical energy the system is capable of delivering to the drill string and the bit will be apparent. However, the embodiment of FIG. 8, with its narrower pulse width, is useful in applications where pulsations in the flow are desired to provide structured jets or improved bottom hole cleaning with relatively little in the way of mechanical impulse energy being delivered to the bit.

Returning again to a consideration of factors affecting the magnitude of the pressure pulses provided, it is further noted that since Kinetic energy is proportional to the square of the velocity, reductions in diameter increasing the flow velocity in the bore 60 will have a significant effect on maximum energy available. Furthermore by increasing the velocity we increase the available rise in pressure due to water hammer effect, i.e. the momentary pressure rise=(specific density of drill fluid×speed of sound in drilling fluid×actual flow velocity of drill fluid). The momentary pressure rise acts on the face 66 of the Venturi body and the total force acting downwardly resulting from the WHE equals the momentary pressure rise×area of face 66.

Since, with each closure of the flap 74, a sharp pressure pulse will begin to travel upwardly, and since these upwardly travelling impulses will move along the drill string, it may be desirable to dampen them to some degree to reduce the chances of any detrimental effects arising. Accordingly, the lower end portion 96 of the neck 32 is provided with an energy absorbing collar 98 made from a tough resilient rubber-like (elastomeric) material, the outer surface being of conical form to intercept and gradually attenuate the upwardly moving train of pressure pulses.

As described previously there is a form of telescopic connection between the upper and lower tool housing portions permitting limited relative axial movement between them. Under certain conditions accelerations of the intermediate and bottom housings 22 and 24 can take place independently of the entire drill string. The vibrations are of minor amplitude so there may be no actual separation between annular shoulders 44, 46 except under conditions where very light drill string weight is applied, i e. a lifting force could be applied to the drill string to reduce bit weight and give a vibrating bit effect. In general, at high bit weight (e.g. over 50,000 lbs.) there will likely be no difference in function between a telescoping housing and one that is non-telescopic (i.e. completely solid). At low bit weight, e.g. 20,000 lbs. the telescopic feature appears to come into play to provide the vibrating bit action coupled with low drill string weight.

The lower and upper tool portions are not only telescopically connected but also hydrostatically balanced (i.e. the inside diameters of the seals 52 and 54 are the same). The forces arising from WHE are transferred through the tool lower portion 24 (at the speed of sound in steel) to the bit. This vibration helps to break the rock while at the same time the cuttings are vibrated to enhance chip removal. Since the pressure pulses have a substantial width (as compared with the sharp instantaneous impulse in prior art hammers having steel-to-steel hammer-anvil contact) substantial energy is transferred to the bit but the action is much more gentle and less likely to damage the bit.

It is also noted here that the structures described are usable with conventional "rolling cone" bits, polycrystalline diamond bits and diamond bits as well. When using the diamond bit an arrangement providing reduced mechanical energy to the bit (e.g. the FIG. 8 embodiment) may be preferred. In all cases the bits will have enhanced performance due to better bottom hole cleaning of cuttings and/or the presence of structured jets as described hereafter.

An embodiment in accordance with FIGS. 1-5 has been operated within a wide range of frequencies and pressure pulses as high as 2500 psi have been observed. By varying the dimensions of the flap 74 and its surrounding structure and, to some extent, the pressure of the drill fluid, lower pulsation rates can be obtained.

Another arrangement is shown in FIGS. 9-12. Here the Venturi body 100 is of a shortened configuration and does not include a distinct diffusor section. Diffusion or expansion of the fluid takes place downstream in an enlarged region of the housing as indicated by the dashed lines in FIG. 10. The Venturi body 100 is disposed and seated in a housing similar to that described previously (although it need not be a "telescoping" housing) to receive a downward flow of drilling fluid. The flow is accelerated through the narrow slot-like passage 102 as described above. The flap 104 is pivoted at its upstream end on pivot shaft 106 in essentially the same manner as the embodiment of FIG. 8 and oscillates between Venturi body internal surfaces 108 and 110 in essentially the same fashion as described previously. Flap 104 includes bevelled portions 112 to match the configuration of the internal surfaces 110 and to allow adequate angular motion of the flap 104. The manner of operation will be apparent from the preceding description and need not be described further here.

Reference will now be had to a still further embodiment of the invention as shown in FIG. 13 which is a longitudinal sectional view through this alternative embodiment.

In this embodiment, the apparatus is disposed in a cartridge housing comprising cartridge portions 122 and 128 connected together by screw-thread portion 132. This cartridge is disposed within an external housing (see dashed lines) which transmits the drill string weight and torque.

The apparatus includes an annular carbide Venturi flow constrictor 125 disposed within the cartridge and which defines a throat portion 134 through which the high velocity fluid passes. An annular ring 127 co-operates with Venturi constriction 125 and serves to hold Constriction 15 together with seal 126 in place. Item 126 is an annular seal that seals the pressure above restriction 125. Constriction 125 and ring 127 together define an upstream conical section 133 within which the downwardly moving drilling fluid is accelerated. The Venturi constriction 125 includes a downstream outwardly flaring or conical section (having a diverging conical surface 138) and within which is mounted a valve member 124 for movement in an axial direction. This valve member is mounted for such movement on an axially disposed guide pin 123. This guide pin 123 is in turn axially secured by virtue of a guide pin holder which includes a central hub 140 and several radially extending spokes 141 which permit the flow to pass freely therearound.

The valve member 124, also of carbide material, is depicted with its upper half in the closed position and its lower portion in the open position. The valve member is provided with a venting groove 137*a*.

In operation, the downwardly moving drilling fluid is accelerated in the constriction region 133. In the throat 134 and in annular region 135 thereafter, the fluid velocity is relatively high and hence the pressure (p2) is relatively low as compared with the incoming pressure (pl). At this point it should be noted that there is an upstream axially centered carbide pin 129 a downstream portion which projects through and past the throat 134 and is axially centered therewith. This downstream portion has a conical surface 137 which directs the flow radially outwardly so that it does not exert dynamic pressure on valve member 124 and so that it tends to flow along the outwardly, diverging surface 138 of the Venturi constriction 125. By virtue of the "Coanda effect", one is assured that this stream of relatively high velocity drilling fluid flows along in contact with this outwardly diverging surface 138. At the same time, in region 139 there is a relatively low pressure (p2) (which appears to be due to a vacuum effect).

After the drilling fluid leaves the annular region 135 as shown it enters into an annular region of somewhat larger cross-section 136 and the fluid velocity decreases as the pressure increases to a pressure (p3). Hence, it can be said that (p1) is greater than (p3) with (p3) being greater than (p2).

This pressure (p3) acts on the projected area of the valve member 124 in the upward direction and the resultant force is greater than force created by pressure (p2) acting on the projected area of valve member 124 in the downward direction. The net result of this force imbalance is that valve member 124 moves upwardly, keeping in mind that at the same time there is no dynamic pressure from the fluid acting on valve member 124 due to the fact that the flow is closely following the surface 138 as described above.

Once valve member 124 reaches the upward closed position as shown in half section (upper half of drawing) its frustro-conical surface portion 124*a* engages surface 138 thus stopping the flow. Hence, in annular region 131 just downstream of throat 134, we now have the sum total of the static pressure plus the water-hammer effect. In other words, (p1) is equal to (p2), the latter being greater than (p3). Thus, below the valve member the pressure decreases and above it the pressure increases thus changing the force balance so that valve member 124 moves or opens axially downwardly and the whole process repeats itself rapidly in continuous cyclical fashion.

Referring now to FIG. 14 which is a longitudinal section view of a still further embodiment of the apparatus, there is shown a very simple arrangement wherein the operative or flow control element is in the form of a flexible tubular member. As with the preceding embodiments, the axially moving flow at pressure (p1) enters a flow constriction 210 wherein the flow is accelerated. At the outlet end of the device there is provided an outwardly flaring diffuser section 212 where the flow velocity is decreased. Extending between the diffuser section and the upstream flow constriction 210, is a flexible elongated rubber or rubber-like tubular control member 216. This is clamped to the diffuser at 218 and to the flow constriction 210 at 220. The structure is arranged such that the downstream pressure (p3) at the diffuser outlet applies all around the exterior of the flexible control member 216.

In operation, the embodiment of FIG. 14 functions in much the same manner as the embodiments described previously. The axially moving fluid enters the constriction 210 an the flow is accelerated thus increasing the velocity while at the same time lowering the pressure (p2) within the control member 216. In the diffuser 212, the flow is decelerated and the downstream pressure increases to (p3). This increased pressure (p3) applies all around the exterior of the control member 216 and the resulting differential pressure causes the control member to collapse inwardly thus suddenly restricting the flow. As soon as the flow is interrupted, the incoming pressure (p1) is substantially increased by virtue of the water-hammer effect and, at the same time, the downstream pressure (p3) is reduced and this reduced pressure surrounds the flexible control member 216. As a result of this reversed differential pressure, the flexible control member 216 opens or expands outwardly thus again opening the flow passage whereupon the above sequence of steps is repeated. Again, as with the other embodiments, this action occurs in a rapid cyclical fashion to effect the previously described pulsations in the flow of fluid moving downstream. It will of course be appreciated that the pulse width associated with this embodiment will be narrow as compared with the FIGS. 1-5 embodiment.

It has already been noted that the higher pulsation frequencies made available by the present invention especially the embodiment of FIGS. 1-5 enable the formation of structured jets at the drill bit. This gives rise to more efficient cleaning at the hole bottom resulting in a faster rate of penetration. Additionally, owing to the higher pulsation frequency, there is faster attenuation of the upwardly moving pressure wave and hence the major part of the pressure wave effect will be contained in the lower section of the drill string, i.e. in the drill collar section, thus giving rise to increased safety.

Another benefit is that since structured jets at the drill bit nozzles will be inherently more effective in cleaning (removing rock chips from the bottom) one can use larger jet nozzles thus resulting in lower pump pressures. The lower pump pressures in turn can result in significant fuel savings, it being kept in mind that the drill string pumps are typically driven by diesel engines which produce in the order of 350–650 horsepower depending upon the particular set-up. It seems apparent that by reducing the required pump pressures one could effect significant reductions in the required horsepower.

During field tests, pump pressures substantially lower than those used with prior art equipment produced good results while at the same time by using the invention a considerably faster drilling rate was achieved. Tests carried out thus far have indicated that oscillation (flow pulsation) rates exceeding one thousand cycles/-second can be achieved. The conclusion is that with apparatus in accordance with the invention one can produce structured jets with all their benefits.

CREATION OF A STRUCTURED JET

Reference may be had to page 5 of the V. E. Johnson, Jr. et al article referred to earlier in this specification. Reference is had in that article to a parameter known as Strouhal's number.

$$\text{Strouhal's number } Sd = \frac{f \times d}{v}$$

where
f=frequency
d=jet diameter
v=jet velocity

In a typical drilling situation:

| | |
|---|---|
| Jet diameter | $d = 7.9$ mm |
| Jet velocity | $v = 37$ m/sec |

Consider a minimum Strouhal's number of 0.2; then the minimum frequency required to have a structured jet is:

$$f = \frac{Sd \times v}{d} = \frac{.2 \times 37}{.0079} = 936.7 \text{ Hz}$$

In order to reduce the required frequency one could reduce jet velocity by increasing the jet diameter.

As noted above during testing to date frequencies in a wide range were produced. The benefits of this wide range of operation will be readily apparent to those skilled in the art from the descriptions given above.

Other suggested uses of the invention in the course of down-hole operations are:

(a) shaking of tubing to clean screens;

(b) vibrating of cement during cementing operations;

(c) pulsating a fluid being pumped into a formation to fracture it;

(d) vibrating a fishing jar to free a stuck bit.

Numerous non-drilling related applications wherein pulsations in a flow of fluid are desired will become apparent to persons skilled in the art of fluid mechanics generally.

Many variations of the flow pulsing apparatus will become apparent to those skilled in the art from the description given above. For definitions of the invention reference should be had to the appended claims.

I claim:

1. A flow pulsing apparatus including a housing having means providing a passage for a flow of fluid and means for periodically interrupting the flow through said passage to create a cyclical water-hammer effect to vibrate the housing and provide pulsations in the flow during use, said means for periodically interrupting the flow including a constriction means in the passage to accelerate the flow to a higher velocity and a first passage region through which the accelerated higher velocity fluid flows followed by an enlarged downstream passage region adapted to provide for a reduced fluid velocity and a control means having a pair of generally opposed faces, said control means being associated with said first passage region and being movable between a substantially open full-flow position and a substantially closed flow interrupting position, said control means, in use, having one of said faces at least partially exposed to the higher velocity fluid flow provided by said first passage region such that (a) when the control means is in the open position the higher velocity fluid flow tends to reduce the pressure force acting on at least a portion of said one face and (b) when the control means is in the closed position the flow interruption creates a fluid pressure force increase acting on at least a portion of said one face while the other of said faces of the control means is, in use, at least partially exposed to the fluid pressures existing in said downstream passage region with said control means thus tending to be moved rapidly or to vibrate between the substantially open and substantially closed positions under the influence of the alternating differential pressure forces acting on said opposed faces of the control means during use.

2. The flow pulsing apparatus according to claim 1 wherein the alternating differential pressure forces are created in that:

(a) in the open position of the control means the accelerated higher velocity fluid flows along said one face, reducing the pressure force thereon generally by Bernoulli effect, while the pressure force on the other generally opposed face tends to increase by virtue of its exposure to the pressure associated with the downstream region of reduced fluid velocity thus tending to close the control means, and (b) in the closed position of the control means the flow interruption creates a water hammer effect thus effecting said increase in the pressure force on said at least a portion of said one face of the control means while at the same time the pressure in the downstream passage region drops thus reducing the pressure force on the other generally opposed face of the control means thus tending to open the control means, (c) with steps (a) and (b) repeating in rapid cyclical fashion, whereby said control means vibrates rapidly between said open and closed positions thereby to effect the pulsations in the flow of fluid.

3. The flow pulsing apparatus according to claim 1 or 2 further including flow restriction means downstream of said control member whereby a back-pressure is maintained in said downstream passage region during operation.

4. The flow pulsing apparatus according to claim 2 or 3 when adapted to be connected in a drill string above a drill bit with the water hammer effect producing pulsations in the flow of drilling fluid moving toward the bit thus vibrating the housing and the drill bit during use.

5. The combination with a hollow drill string having a drill bit thereon having jet nozzles therein of apparatus according to claim 4 to provide pulsations in a flow of drilling fluid passing toward the bit along the drill string and through said nozzles, said apparatus including a telescoping housing portion which is hydrostatically balanced, with water-hammer effects being transmitted via a lower portion of said housing to the bit.

6. Apparatus as in claim 1 or 2 wherein said control means comprises a pivoting flap member.

7. Apparatus as in claim 1 or 2 wherein said control means comprises an axially movable valve member.

8. Apparatus as in claim 1 or 2 wherein said control means comprises a flexible tubular member which expands and collapses between the open and closed positions.

9. Apparatus as in claim 1 or 2 wherein said control means comprises a flap member, said flap member being mounted for pivotal motion between the open and closed positions.

10. Apparatus as in claim 1 or 2 wherein said control means comprises a flap member, said flap member being mounted for pivotal motion between the open and closed positions about a pivot means disposed adjacent a downstream end portion of the flap member.

11. Apparatus as in claim 1 or 2 wherein said control means comprises a flap member, said flap member being mounted for pivotal motion between the open and closed positions about a pivot means disposed adjacent a downstream end portion of the flap member, said flap member being shaped such that a water hammer effect tending to move the flap member from the closed position toward the open position acts on an area of said one face which is substantially smaller than the area of said opposing face on which the downstream pressure acts, thereby tending to provide relatively broad or longer duration pressure pulses in the flow.

12. Apparatus as in claim 1 or 2 wherein said control means comprises a pair of co-operable flap members pivotally mounted at respective upstream and downstream locations.

13. Apparatus as in claim 1 or 2 wherein said control means comprises a pair of co-operable flap members pivotally mounted at respective upstream and downstream locations, said co-operable flap members together defining an area exposed to the fluid pressure existing in the downstream passage region which is substantially more than the combined area of said flap members which is exposed to the pressure force arising from water hammer effect thereby tending to provide relatively broad or long duration pressure pulses in the flow.

14. Apparatus as in claim 1 or 2 wherein said control means comprises a flap member, said flap member being mounted for pivotal motion between the open and closed positions about a pivot means disposed adjacent an upstream end portion of the flap member.

15. Apparatus as in claim 1 or 2 wherein said control means comprises a flap member, said flap member being mounted for pivotal motion between the open and closed positions about a pivot means disposed adjacent an upstream end portion of the flap member, said flap member being shaped such that the water-hammer effect tending to move the flap member toward the open position acts on an area of said one face which is substantially equal to the area of said opposing face on which the downstream pressure acts thereby tending to provide relatively short duration pressure pulses in the flow.

16. The combination with a hollow drill string having a drill bit thereon having jet nozzles therein of apparatus according to claim 1 or 2 to provide pulsations in a flow of drilling fluid passing toward the bit along the drill string and through said nozzles.

17. A combination as in claim 16 including means to dampen vibrations moving up the string.

18. A flow pulsing method including flowing a fluid through a passage while periodically interrupting the flow to create pulsations in the flow and a cyclical water-hammer effect, characterized by passing the fluid through a constriction means in the passage to accelerate the flow to a higher velocity and thence into a first passage region through which the accelerated higher velocity fluid flows and thereafter passing the fluid through a downstream passage region arranged to reduce the fluid velocity, there being a control means having generally opposed faces, which control means is associated with said first passage region and is movable between a generally open full-flow position and a closed generally flow interrupting position, and exposing one face of said control means to the higher velocity fluid flow in said first passage region while the opposing face thereof is exposed to the fluid pressure existing in said downstream passage region of lower fluid velocity so that said control means tends to be moved rapidly or to vibrate between the generally open and closed positions by virtue of alternating differential pressure forces arising from Bernoulli and water-hammer effects acting on said generally opposed faces of the control member.

19. The flow pulsing method according to claim 18 wherein the alternating differential pressure forces are created in that:

(a) in the open position of the control means the higher velocity fluid in the first passage region flows along said one face thus reducing the pressure force thereon by Bernoulli effect while the pressure force on said opposing face tends to increase by virtue of its exposure to the pressure of the downstream region of reduced fluid velocity thus tending to close the control means, and (b) in the closed position of the control means the flow interruption creates a water hammer effect thus increasing the pressure force on at least a portion of said one face of the control means while at the same time the pressure in the downstream passage region drops thus reducing the pressure force on said opposite face of the control means thus tending to open the control means, (c) steps (a) and (b) being repeated in rapid cyclical fashion, whereby said control means vibrates rapidly between said open and closed positions thereby to effect pulsations in the flow of fluid.

20. The flow pulsing method according to claim 19 further including restricting the flow downstream of said control member whereby a back-pressure is maintained in said downstream passage region during operation.

21. The flow pulsing method apparatus according to claim 19 when carried out in a drill string above a drill bit to provide pulsations in the flow of drilling fluid moving toward the bit and to vibrate the housing and the drill bit during use.

22. The method as in claim 19 wherein said control means moves by pivoting about an axis.

23. The method as in claim 19 wherein said control means moves axially between the open and closed positions.

24. The method as in claim 19 wherein said control means comprises a flexible tubular member which expands and collapses between the open and closed positions.

* * * * *